US006096097A

United States Patent [19]

Kümmeler et al.

[11] Patent Number: 6,096,097

[45] **Date of Patent: *Aug. 1, 2000**

[54] SIMULTANEOUS WASHING AND BLEACHING OF NATIVE FIBRES AND TEXTILE PRODUCTS THEREFROM

[75] Inventors: Ferdinand Kümmeler; Josef Pfeiffer; Michael Pirkotsch, all of Leverkusen; Torsten Groth, Odenthal; Winfried Joentgen, Köln, all of Germany

[73] Assignee: Bayer Aktiengesellschaft, Leverkusen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/259,200

[22] Filed: Mar. 1, 1999

[30] Foreign Application Priority Data

Mar. 5, 1998 [DE] Germany ..... 198 09 359

[51] Int. Cl.[7] ..... D06L 3/02

[52] U.S. Cl. ..... 8/111; 8/137; 8/139; 510/313; 510/375; 510/376; 510/378; 510/318; 510/477; 510/478; 510/480; 510/476

[58] Field of Search ..... 8/137, 139, 111; 510/475, 476, 477, 478, 372, 375, 376, 378, 309, 312, 313, 480, 318

[56] References Cited

U.S. PATENT DOCUMENTS

| | | | |
|---|---|---|---|
| 3,846,380 | 11/1974 | Fujimoto et al. | 260/78 A |
| 3,912,662 | 10/1975 | Martinsson et al. | 252/527 |
| 3,927,204 | 12/1975 | Neri et al. | 424/78 |
| 4,363,797 | 12/1982 | Jacquet et al. | 424/70 |
| 4,839,461 | 6/1989 | Boehmke | 528/363 |
| 4,906,473 | 3/1990 | Bader et al. | 424/426 |
| 5,041,291 | 8/1991 | Bader et al. | 424/426 |
| 5,175,285 | 12/1992 | Lehmann et al. | 544/141 |
| 5,329,020 | 7/1994 | Kalota et al. . | |
| 5,362,412 | 11/1994 | Hartman et al. . | |
| 5,372,610 | 12/1994 | Kahle et al. | 8/111 |
| 5,510,055 | 4/1996 | Raimann | 252/186.25 |
| 5,516,758 | 5/1996 | Stevens et al. | 514/12 |
| 5,543,490 | 8/1996 | Groth et al. | 528/328 |
| 5,755,992 | 5/1998 | Jeffrey et al. . | |

FOREIGN PATENT DOCUMENTS

| | | |
|---|---|---|
| 2144371 | 9/1995 | Canada . |
| 0 696 661 | 2/1996 | European Pat. Off. . |
| 0 757 094 | 2/1997 | European Pat. Off. . |
| 0 831 165 | 3/1998 | European Pat. Off. . |
| 3739610 | 6/1989 | Germany . |
| 6329607 | 11/1994 | Japan . |
| 6330020 | 11/1994 | Japan . |
| 9-310097 | 12/1997 | Japan . |
| 1306331 | 2/1973 | United Kingdom . |
| 1404814 | 9/1975 | United Kingdom . |

OTHER PUBLICATIONS

Database WPI, AN 75–00952W, XP002106526 & SU 408 578 (Leningrad Textile Light) Aug. 16, 1974.

Database WPI, AN 95–048801, XP002106527 & JP 06 329607 (Nippon Shokubai Co Ltd) Nov. 29, 1994.

*Primary Examiner*—Margaret Einsmann

*Attorney, Agent, or Firm*—Joseph C. Gil; Diderico van Eyl; Richard E. L. Henderson

[57] ABSTRACT

Raw native fibers and textile products therefrom can be simultaneously washed and bleached in one liquor if the liquor has added to it a combination product of a) one or more bleach stabilizers, b) one or more surfactants from the group of the nonionic, amphoteric and cationic surfactants, c) optionally one or more dispersants and d) optionally further components.

16 Claims, No Drawings

SIMULTANEOUS WASHING AND BLEACHING OF NATIVE FIBRES AND TEXTILE PRODUCTS THEREFROM

BACKGROUND OF THE INVENTION

The present invention relates to a process for the simultaneous washing and bleaching of raw native fibers, blends of a plurality thereof or their blends with synthetic fibers, and yams or textile products produced therefrom. Such simultaneous washing and bleaching is the necessary pretreatment prior to the aforementioned fibers, fiber blends and textile products being coloured. The invention further relates to a combination product for carrying out this process.

Textile-forming native vegetable fibers, such as cotton, sisal and jute, and also native animal fibers, such as silk and wool, contain waxes, fats and other animal or vegetable constituents responsible for a yellowish brown colouring of the fiber in the raw state. As a result, not all shades which it is desired to dye are possible, or they are obtained in an unlevel form. When native fibers are blended with synthetic fibers, for example with polyamide, polyester, elastane or others, components which interfere with the dyeing additionally include spin finish oils, for example winding oil or silicone oil, as well as the aforementioned waxes and fats on native fibers.

To remove the aforementioned interfering constituents and also spin finish oils and in addition to oxidatively destroy the yellowish brown colouring, it has hitherto been customary to carry out separate washing and bleaching operations to pretreat the abovementioned fibers, fiber blends and their textile products. The treatment liquors used contain water, $H_2O_2$, wetting/washing and emulsifying agents, alkali and bleach regulators/sequestrants. The regulators used used to include waterglass and/or inorganic phosphates. Waterglass had the disadvantage of leading to insoluble calcium silicate deposits being formed on the material and machinery, and the phosphates contributed to the eutrophication of effluents.

The polyphosphates which took their place are in turn very slow to biodegrade, if they do so at all, and thus are other kinds of water pollutants. Ethylenediaminetetraacetic acid (EDTA), which likewise does not biodegrade and in addition is not absorbed by the sewage sludge of a water treatment plant, is another water pollutant and is therefore undesirable for use as a bleach regulator; in addition, in the case of EDTA, it is not possible to completely rule out a remobilization of heavy metals, which are thus able to reenter the biological cycle. Phosphonobutanetricarboxylic acid regulators, too, have a very poor biodegradation rate. It is therefore desirable that EDTA, phosphonobutanetricarboxylic acids, polyphosphates and others only be used in minor amounts in formulations.

Hitherto it appeared to be very difficult to combine washing and bleaching, since the respective objectives and the auxiliaries consequently used are completely different. Furthermore, a very large amount of water is required on account of the two liquors required and the additional rinses. However, the desirable unification of the washing and bleaching processes appeared to fail because of the multiplicity of recipe ingredients required, since in practice it was impossible to rule out mistaken identities and incorrect dispensing, which ultimately led to an off-spec textile material which had to be retreated, thereby necessitating further large water quantities.

It has now been found that it is not just possible to combine the two operations, namely the operations of washing and of bleaching, but that it is also possible to avoid incorrect dispensing by using an inventive combination product of the below-described kind, and thereafter adding to the liquor only the alkali required for setting the pH and also the $H_2O_2$ required.

SUMMARY OF THE INVENTION

The invention relates to a process for the simultaneous washing and bleaching of raw native fibers, blends of a plurality thereof or their blends with synthetic fibers, yarns or textile products produced therefrom, prior to their dyeing and/or further processing, characterized in that the fibers, their blends, yarns and textile products are treated with just one liquor comprising a combination product of a) 15–65% by weight of one or more bleach stabilizers, b) 15–65% by weight of one or more surfactants from the group of the nonionic, amphoteric and cationic surfactants, c) 0–50% by weight of one or more dispersants, and d) 0–20% by weight of further components, the percentages being based on the total amount of the anhydrous components of a), b) and optionally c) and optionally d), which is rendered alkaline and has a peroxy compound added to it.

The invention further relates to a combination product for carrying out the process of the invention, characterized by a composition of a) 15–65% by weight of one or more bleach stabilizers, b) 15–65% by weight of one or more surfactants from the group of the nonionic, amphoteric and cationic surfactants, c) 0–50% by weight of one or more dispersants, and d) 0–20% by weight of further components, the percentages being based on the total amount of the anhydrous components of a), b) and optionally c) and optionally d).

DETAILED DESCRIPTION OF THE INVENTION

As bleach stabilizers a) there can in principle be used those hitherto used and named above, such as phosphonoalkanepolycarboxylic acids, ethylenediaminetetraacetic acid (EDTA), nitrilotriacetic acid (NTA), polyhydroxycarboxylic acids, such as gluconic acid or citric acid, polyphosphates and others. However, preference is given to using biodegradable iminopolycarboxylic acids, for example iminodisuccinic acid (IDS), to which the aforementioned previous bleach stabilizers can be added in minor proportions. Suitable bleach stabilizers a) for the process of the invention are in particular iminopolycarboxylic acids or their salts as per the formula (I)

(I)

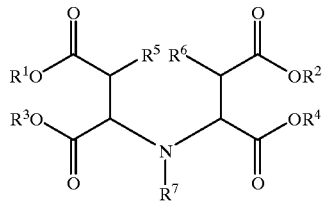

where $R^1$, $R^2$, $R^3$ and $R^4$ are independently H, Li, Na, K, $NH_4$, $H_3N(CH_2CH_2OH)$, $H_2N(CH_2CH_2OH)_2$ or $HN(CH_2CH_2OH)_3$, $R^5$ and $R^6$ are independently H or OH and $R^7$ is H, $CH_2CH_2OH$, $CH_2CH_2CH_2OH$, $CH_2CH(OH)CH_3$, $CH_2COOR^8$ or $CH_2CH_2COOR^8$, where $R^8$ has the scope of meanings of $R^1$, independently of $R^1$, and also mixtures thereof.

$R^6$ is preferably H, and $R^5$ and $R^6$ are each particularly preferably H. It is likewise preferred for $R^7$ to be H. It is further preferred for $R^5$, $R^6$ and $R^7$ all to be H, so that the unsubstituted iminodisuccinic acid or its salts of the above-defined type are present (both the acid and its salts are subsumed under IDS).

It is further preferred for $R^1$, $R^2$, $R^3$ and $R^4$ each to be H, Na, K, $NH_4$ or $H_3N(CH_2CH_2OH)$.

The bleach stabilizers a) of the invention which comprise substances of the formula (I) are present either in pure form or associated with small amounts of secondary components from the synthesis of (I), such as maleic acid, fumaric acid, aspartic acid, malic acid, asparagine, tartaric acid, hydroxyaspartic acid, condensates of aspartic acid or salts thereof having the above-indicated preferred meanings of $R^1$ to $R^4$, i.e. H, Na, K, $NH_4$ or $H_3N(CH_2CH_2OH)$. These secondary components are present in the mixture in an amount of not more than 35% by weight, preferably not more than 30% by weight, particularly preferably not more than 25% by weight; the difference to 100% by weight is (I).

(I) is prepared by known processes in an aqueous medium, for example from maleic anhydride, maleic acid or epoxysuccinic acid and ammonia or aspartic acid. Processes of this kind are described in GB 1 306 331, JP 6/329 607, JP 6/330 020 and DE 3 739 610.

IDS of the formula (I) is preferably used in an amount of 50 to 100% by weight of the total amount of bleach stabilizers a), preferably in an amount of 80 to 100% of the total amount of bleach stabilizers a) optionally alongside the abovementioned bleach stabilizers hitherto used.

As surfactant b) there are used one or more surfactants from the group of the nonionic, amphoteric and cationic surfactants. Nonionic surfactants are polyethers, known to the person skilled in the art, composed of ethylene oxide and/or propylene oxide units, which are initiated on compounds having a mobile hydrogen atom, such as alcohols, phenols, alkylphenols, styrene-substituted phenols, carboxylic acids, carboxamides and amines, these initiator molecules having 8 to 22 carbon atoms, preferably 12 to 20 carbon atoms. The initiator molecules are reacted with 3 to 10 mol of ethylene oxide (EO) and optionally 2 to 5 mol of propylene oxide (PO). Amphoteric surfactants for the process of the invention are amine oxides, betaines and sulphobetaines containing a $C_{10}$–$C_{22}$-hydrocarbyl radical.

Preferred amphoteric surfactants are betaines of the formula (II)

$$(C_{10}\text{–}C_{22}\text{-alk(en)yl)—X—N}^{\oplus}(R^1,R^2)\text{—(}C_1\text{–}C_4\text{-(hydroxy)alkylene)—COO}^{\ominus} \quad \text{(II)},$$

where

X is a single bond or the group —CO—NH—($C_2$–$C_3$-alkyl)—, and $R^1$ and $R^2$ are independently hydrogen, methyl or hydroxyethyl.

Of these betaines, preferred ones have the formula (III)

$$(C_{10}\text{–}C_{22}\text{-alkyl)—N}^{\oplus}(R^1,R^2)\text{—CH}_2\text{COO}^{\ominus} \quad \text{(III)},$$

where $R^1$ and $R^2$ are each as defined for the formula (II) and $R^1$=$R^2$.

Of the amine oxides, preferred ones have the formula (IV)

$$(C_{10}\text{–}C_{22}\text{-alk(en)yl)—X—N}(R^1,R^2)\rightarrow O \quad \text{(IV)}$$

where

X, $R^1$ and $R^2$ are each as defined for the formula (II).

Particularly preferred amine oxides have the formula (V), $$(C_{10}\text{–}C_{22}\text{-alkyl)—N}(R^1,R^2)\rightarrow O \quad \text{(V)},$$

where $R^1$ and $R^2$ are each as defined for the formula (II) and $R^1$=$R^2$.

Specific examples of suitable betaines (III) are dodecyldimethylbetaine, cocalkyldimethylbetaine, tetradecyldimethylbetaine, octadecyldimethylbetaine, tallowalkyldimethylbetaine, oleyldimethylbetaine, cocalkylbishydroxyethylbetaine, stearylbishydroxyethylbetaine, tallowalkylbishydroxyethylbetaine.

Specific examples of suitable amine oxides (IV) include for example dodecyldimethyl-amine oxide, cocalkyldimethylamine oxide, tetradecyldimethylamine oxide, octadecyldimethylamine oxide, tallowalkyldimethylamine oxide, oleyldimethylamine oxide, cocalkylbishydroxyethylamine oxide, stearylbishydroxyethylamine oxide, tallowalkylbishydroxyethylamine oxide.

Cationic surfactants are the known quaternary ammonium salts which bear one or two, preferably one, $C_{10}$–$C_{22}$-alkyl radical, the remaining substituents on the positively charged nitrogen atom being $C_1$–$C_4$-alkyl radicals.

Of the surfactants mentioned, the nonionic ones and the amphoteric ones are preferred.

It may be advantageous for the combination product of the invention to include as a further component c) a dispersant, such as polyaspartic acid (PAS) or a naphthaleneformaldehydesulphonate. Further dispersants for use in the process of the invention are for example condensation products of phenol, fatty amines, formaldehyde and EO and condensation products of formaldehyde with diphenyl sulphone and/or phenolsulphonic acids and/or benzenesulphonic acids.

PAS can be prepared for example from maleic anhydride, water and ammonia (U.S. Pat. No. 4,839,461). Maleic anhydride can initially be converted into the monoammonium salt in an aqueous medium by adding concentrated ammonia solution. In a preferred embodiment, PAS is prepared by subjecting the monoammonium salt of maleic acid to a batchwise or continuous thermal polymerization which is preferably carried out at 150 to 180° C. in a reactor with a residence time of 5 to 300 minutes and the polysuccinimide obtained is hydrolyzed to convert it into PAS or a salt thereof. Examples of cations in the salts are $Li^{\oplus}$, $Na^{\oplus}$, $K^{\oplus}$, $Mg^{\oplus\oplus}$, $Ca^{\oplus\oplus}$, $NH_4^{\oplus}$, $H_3N(CH_2CH_2OH)^{\oplus}$, $H_2N(CH_2CH_2OH)_2^{\oplus}$ or $HN(CH_2CH_2OH)_3^{\oplus}$.

In a preferred embodiment, the PAS contains essentially repeat units of the following structure i) 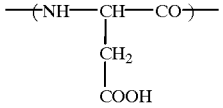 (α-form)

and ii) 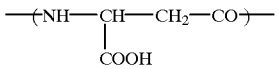 (β-form)

generally with a proportion of the β-form of more than 50%, especially more than 70%.

In addition to the recurring PAS units i) and ii), further recurring units can be present, for example:

iii) malic acid units of the formula

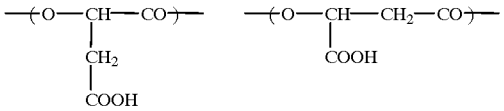

iv) maleic acid units of the formula

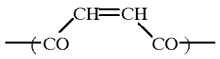

v) fumaric acid units of the formula

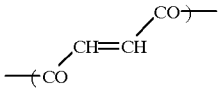

Preference is given to PAS types having a gel permeation chromatography analysis (calibrated with polystyrene) molecular weight of 500 to 10,000, preferably 1000 to 5000, particularly preferably 2000 to 4000 (as weight average).

The amount of the further recurring units iii), iv) and v) can be 0 to 100% by weight, based on the sum total of the α- and β-form.

As well as the salts with the abovementioned cations suitable PAS derivatives include polysuccinimide formed at elevated temperature, preferably at 100 to 240° C., in the absence or presence of a catalyst. The catalyst is customarily used in an amount of 0.01 to 1% by weight, based on the PAS. Preference is given to acidic catalysts, such as sulphuric acid, phosphoric acid and methanesulphonic acid. However, polysuccinimide is also produced directly in a number of preparative processes. In such a case, polysuccinimide can be converted by reaction with a base, in the presence or absence of water, into a salt with one of the abovementioned cations. This conversion takes place by hydrolysis in a suitable apparatus following the preparative process. The preferred pH for the hydrolysis is 5 to 14, preferably 7 to 12. Suitable bases for an alkaline hydrolysis are alkali and alkaline earth metal hydroxides or carbonates, for example sodium hydroxide, potassium hydroxide, sodium carbonate, potassium carbonate, also ammonia and amines, such as triethylamine, triethanolamine, diethylamine, diethanolamine and ethanolamine.

Further PAS derivatives useful for the invention are those in which some of the carboxyl groups in the PAS are present in the form of amides. Such PAS amides can be prepared from the abovementioned polysuccinimide by reaction with primary or secondary amines (DE-A 22 53 190, EP-A-0 274 127, EP-A-0 406 623, EP-A-0 519 119, U.S. Pat. No. 3,846,380, U.S. Pat. No. 3,927,204, U.S. Pat. No. 4,363,797). The succinimide structures remaining following amide formation can subsequently be converted into free carboxyl or carboxylate groups by the abovementioned hydrolytic opening in the presence of bases. In preferred derivatives, 5 to 50 mol %, preferably 10 to 35 mol %, of the aspartic acid units present contain such amide structures, while the remaining carboxyl groups are present in the form of carboxylate groups.

Further components d) for the combination product for the process of the invention are solvents, such as methanol, ethanol, n-propanol, isopropanol, butanol, ethylene glycol, ethylene glycol monomethyl ether, propylene glycol monomethyl ether, butylene glycol monomethyl ether, optical brighteners and also scents known to the person skilled in the art.

The combination product of the invention has a composition of a) 15–65% by weight, preferably 20–50% by weight, of one or more bleach stabilizers, b) 15–65% by weight, preferably 20–50% by weight, of one or more surfactants from the group of the nonionic, amphoteric and cationic surfactants, c) 0–50% by weight, preferably 0–40% by weight, of one or more dispersants, and d) 0–20% by weight, preferably 0–15% by weight, of further components, the percentages being based on the total amount of the anhydrous components of a), b) and optionally c) and optionally d).

Components c) and d) are thus not obligatory constituents of the combination product. Nor can the constituents a) and b) both be present in their maximum possible amount; but combinations of, for example, 65% by weight of a) and 35% by weight of b) or 35% by weight of a) and 65% by weight of b) are possible. The combination product of the invention is customarily present as a 15 to 60% strength by weight, preferably 20–50% strength by weight, aqueous solution, and is thus efficiently and consistently meterable in liquid form, and does not separate even in the course of prolonged storage.

The combination product is customarily used in the process of the invention in an amount of 0.3 to 10 ml/l of liquor. After addition of the combination product, the liquor is made alkaline by addition of alkali metal hydroxides, such as NaOH (as aqueous solution), KOH (as aqueous solution), or alkali metal carbonates, such as $Na_2CO_3$ or $K_2CO_3$ (both as solids), preferably being adjusted to a pH of 10 to 14, especially 11 to 14, and $H_2O_2$ (for example as 30% strength or 50% strength aqueous solution) is added. Preference is given to using NaOH and $Na_2CO_3$, especially NaOH in the form of an aqueous solution.

The amount of peroxy compound required depends on the soiling of the raw fibers or the textile products. As peroxy compound there can be used $H_2O_2$, perborate or addition products of $H_2O_2$ with, for example, urea. $H_2O_2$ is preferred because of its low cost and because it decomposes to water.

The process of the invention can be used 1) in the exhaust process (jigger, jet, winch, etc.), 2) the cold pad-batch process or 3) in the PAD-steam process. In what follows, the procedure according to the process of the invention is described for these three variants.

1) Exhaust Process

| | Jigger | Jet | Winch |
|---|---|---|---|
| Liquor ratio | (6–2):1 | (10–8):1 | 20:1 |
| Temperature | | 90–95° C. | |
| Reaction time | | 30–90 minutes | |
| Combination product | 1–4 ml | 0.5–2 ml | 0.5–2 ml |
| NaOH (38° Be = about 32% strength in $H_2O$) | | 3–10 ml | |
| $H_2O_2$ (30% strength) | | 4–15 ml | |

2) Cold Pad-Batch Process

| | Normal | Extraction |
|---|---|---|
| Combination product | 1–4 ml | 0.5–2 ml |
| NaOH (38° B = about 32% strength in $H_2O$) | 20–30 ml | 50–80 ml |
| $H_2O_2$ (30% strength) | 30–60 ml | |

3) PAD-Steam Process

| | Short time | Long time |
|---|---|---|
| Combination product | 3–8 ml | 1–8 ml |
| NaOH (38° B = about 32% strength in $H_2O$) | 10–15 ml | 5–10 ml |
| $H_2O_2$ (30% strength) | 40–60 ml | 10–30 ml |

It can be desirable for the washing/bleaching liquor to include a fluorescent whitening agent, for example of the stilbene type.

The process of the invention, employing the combination product of the invention, produces excellent results, such as outstanding and trouble-free removal of winding oils and/or silicone oil, great whiteness and appreciable savings in terms of time and water. Because no individual components are overdosed, defects are minimized; in addition, more economical stockkeeping of fewer components is possible, making the process of the invention particularly cost-effective.

EXAMPLES

The combined washing and bleaching as per the process of the invention utilizes a liquor having the following constituents:

| Liquor constituents | per 1 of liquor |
|---|---|
| Combination product | 1 ml |
| NaOH (38° Be = about 32% strength in $H_2O$) | 4 ml |
| $Na_2SO_4$ | 4 g |
| $H_2O_2$ | as consumed |
| FWA | 1.5% |

The liquor ratio is 10:1, the inventive washing and bleaching is carried out at 98° C. over 60 minutes, which is followed by 5 minutes of overflow rinsing, then another 10 minutes at 90° C. with the liquor stationary, and finally by a further 5 minutes of overflow rinsing. The FWA is the reaction product of flavonic acid, cyanuric chloride, sulphanilic acid and diisopropanolamine.

Abbreviations used below:

Surfactant A=cocamidopropylbetaine,

Dispersant 1=i-$C_{13}$-alkanol+5 mol of EO

Dispersant 2=mixture of 55% of (i-$C_{13}$-alkanol+4 EO), 7.5% of (oleyl alcohol+19 EO), 10% of butyldiglycol, 7.5% of condensate of (cetylamine, phenol, formaldehyde and 31 EO) and 20% of water.

Combination products according to invention:

| Components | No. 1 (% by weight) |
|---|---|
| a) Phosphonobutanetricarboxylic acid (50% strength in $H_2O$) | 19.85 |
| b) Surfactant A (34% strength in $H_2O$) | 19.85 |
| c) Dispersant 1 (83% strength in $H_2O$) | 9.93 |
| d) Methoxypropanol | 1.98 |
| Water | 48.39 |

| | Combination products (% by weight) | | | | | |
|---|---|---|---|---|---|---|
| Components | No. 2 | No. 3 | No. 4 | No. 5 | No. 6 | No. 7 |
| a) IDS $Na_4$ (33% strength in $H_2O$) | 21.20 | 23.17 | 13.28 | 14.14 | 7.37 | 7.92 |
| b) Surfactant A (47% strength in $H_2O$) | 15.56 | 17.00 | 19.39 | 20.65 | 21.52 | 23.12 |
| c) Dispersant 1 | 10.55 | — | 13.55 | — | 14.59 | — |
| c) Dispersant 2 | — | 11.53 | — | 14.00 | — | 15.68 |
| d) Methoxypropanol | 10.76 | 3.73 | 7.57 | 3.11 | 7.96 | 2.85 |
| Water | 41.93 | 44.57 | 46.61 | 48.09 | 48.56 | 50.44 |

| | Combination products (% by weight) | | | |
|---|---|---|---|---|
| Components | No. 8 | No. 9 | No. 10 | No. 11 |
| a) IDS $Na_4$ (33% strength in $H_2O$) | 23.2 | 23.2 | 23.2 | — |
| a) Phosphonobutanetricarboxylic acid (50% strength in $H_2O$) | — | — | — | 23.2 |
| b) Surfactant A (47% strength in $H_2O$) | 17.0 | 17.0 | 17.0 | 17.0 |
| c) Dispersant 2 | 11.5 | 5.8 | — | 11.5 |
| c) PAS Na salt | — | 5.7 | 11.5 | — |
| d) Methoxypropanol | 3.7 | 3.7 | 3.7 | 3.7 |
| Water | 44.6 | 44.6 | 44.6 | 44.6 |

The examples which follow utilize the combination products Nos 1 to 10 of the invention for the combined washing and bleaching of various textile materials. For comparison, the textile materials are each bleached and washed under identical conditions in a liquor to which the below-stated bleach regulators, surfactants and dispersants were added individually, i.e. not in the form of a ready-prepared combination product.

The amounts of the bleach stabilizers, surfactants and dispersants used in the comparative recipe are kept constant, as a result of which different results are obtained in the comparative tests depending on the textile material used.

| Comparative recipe | % by weight | |
|---|---|---|
| a) Bleach stabilizer | 44.0 | Phosphonobutanetricarboxylic acid |
| a) Bleach regulator | 13.0 | 5 parts of NTA<br>28 parts of gluconic acid (60% strength in $H_2O$)<br>8 parts of citric acid<br>6 parts of NaOH<br>2 parts of MgO<br>51 parts of $H_2O$ |

-continued

| Comparative recipe | % by weight | |
|---|---|---|
| b) Surfactants | 21.5 | 26 parts of betaine of tallowbis (hydroxyethyl)-amine with $ClCH_2COONa$ and<br>7 parts of acetic acid<br>9 parts of methoxypropanol<br>5 parts of a condensation product of phenol, $C_{16}$-amine, formaldehyde and 15 units of EO and<br>53 parts of $H_2O$ |
| c) Dispersant | 21.5 | Dispersant 1 (83% strength in $H_2O$) |

The invention is further described in the following illustrative examples. All parts and percentages are by weight, unless otherwise noted.

Example 1

Material Used: cotton

| | Combination product No. 1 | Comparative recipe |
|---|---|---|
| Residual peroxide in % | 20 | 34 |
| CIE whiteness (with filter) | 76 | 73 |
| Petroleum ether extract in % | 0.47 | 0.39 |

Example 2

Material Used: cotton/elastane

| | Combination products No. | | | | | | Comparative |
|---|---|---|---|---|---|---|---|
| | 2 | 3 | 4 | 5 | 6 | 7 | recipe |
| Residual peroxide in % | 56 | 58 | 60 | 61 | 60 | 58 | 47 |
| CIE whiteness (with filter) | 60 | 59 | 58 | 59 | 60 | 58 | 58 |
| Petroleum ether extract in % | 0.56 | 0.53 | 0.58 | 0.55 | 0.61 | 0.59 | 0.57 |
| Silicone removal in % | — | 45 | — | 43 | — | — | 40 |

Example 3

Material Used: cotton

| | Combination products No. | | | | | | Comparative | Raw material |
|---|---|---|---|---|---|---|---|---|
| | 2 | 3 | 4 | 5 | 6 | 7 | recipe | |
| Residual peroxide in % | | 48 | 49 | 49 | 52 | 52 | 35 | |
| CIE whiteness (with filter) filter) | | 68 | 69 | 68 | 68 | 68 | 69 | |

-continued

| | Combination products No. | | | | | | Comparative | Raw material |
|---|---|---|---|---|---|---|---|---|
| | 2 | 3 | 4 | 5 | 6 | 7 | recipe | |
| Petroleum ether extract in % | — | — | 0.26 | — | 0.23 | — | — | 0.71 |

Example 4

Material Used: cotton/elastane heat-set at 180° C. for 10 sec

| | Combination products No. | | | | | | Comparative |
|---|---|---|---|---|---|---|---|
| | 2 | 3 | 4 | 5 | 6 | 7 | recipe |
| Residual peroxide in % | 65 | 65 | 64 | 65 | 63 | 64 | 64 |
| CIE whiteness (with filter) | 63 | 62 | 63 | 63 | 63 | 64 | 65 |
| Petroleum ether extract in % | 0.43 | 0.43 | 0.44 | 0.46 | 0.43 | 0.49 | 0.70 |
| Silicone removal in % | | 58 | 51 | 30 | 31 | 17 | 40 |

Example 5

Material Used: cotton

| | Combination products No. | | | | Comparative |
|---|---|---|---|---|---|
| | 8 | 9 | 10 | 11 | recipe |
| Residual peroxide in % | 49 | 49 | 47 | 25 | 49 |
| CIE whiteness (with filter) | 70 | 69 | 69 | 72 | 75 |
| Petroleum ether extract in % | 0.23 | 0.22 | 0.20 | 0.20 | 0.18 |

Example 6

Material Used: cotton/elastane

| | Combination products No. | | | | Comparative |
|---|---|---|---|---|---|
| | 8 | 9 | 10 | 11 | recipe |
| Residual peroxide in % | 52 | 54 | 49 | 42 | 43 |
| CIE whiteness (with filter) | 63 | 64 | 62 | 63 | 67 |
| Petroleum ether extract in % | 0.73 | 0.70 | 0.66 | 0.69 | 0.90 |
| Silicone removal in % | 18 | 19 | 23 | 24 | 33 |

Example 7

Material Used: cotton/elastane after heating-setting

| | Combination products No. | | | | Comparative |
|---|---|---|---|---|---|
| | 8 | 9 | 10 | 11 | recipe |
| Residual peroxide in % | 57 | 56 | 57 | 56 | 48 |
| CIE whiteness (with filter) | 62 | 62 | 61 | 63 | 64 |

-continued

| | Combination products No. | | | | Comparative |
|---|---|---|---|---|---|
| | 8 | 9 | 10 | 11 | recipe |
| Petroleum ether extract in % | 0.44 | 0.41 | 0.38 | 0.44 | 0.82 |
| Silicone removal in % | 15 | 17 | 17 | 29 | 38 |

What is claimed is:

1. A process for the simultaneous washing and bleaching of raw native fibers, blends of a plurality of raw native fibers, or blends of raw native fibers with synthetic fibers, yarns, or textile products produced therefrom, prior to their dyeing and/or further processing, said process comprising (A) preparing a liquor comprising a combination product of:

(a) 15–65% by weight of one or more bleach stabilizers, (b) 15–65% by weight of one or more surfactants selected from the group consisting of nonionic surfactants, amphoteric surfactants, and cationic surfactants, (c) 0–50% by weight of one or more dispersants, and (d) 0–20% by weight of further components, wherein the percentages are based on the total amount of the anhydrous components of (a), (b), (c), and (d), (B) rendering the liquor alkaline and adding a peroxy compound to the liquor, and (C) treating raw native fibers, blends of a plurality thereof or their blends with synthetic fibers, yarns, or textile products produced therefrom with the resultant liquor.

2. The process of claim 1 wherein the bleach stabilizer comprises an iminopolycarboxylic acid or salt thereof of the formula (I) or mixtures thereof, (I)

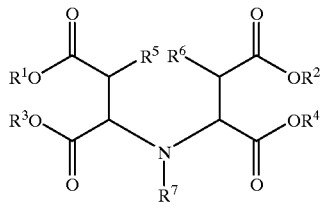

wherein $R^1$, $R^2$, $R^3$ and $R^4$ are independently H, Li, Na, K, $NH_4$, $H_3N(CH_2CH_2OH)$, $H_2N(CH_2CH_2OH)_2$, or $HN(CH_2CH_2OH)_3$, $R^5$ and $R^6$ are independently H or OH, and $R^7$ is H, $CH_2CH_2OH$, $CH_2CH_2CH_2OH$, $CH_2CH(OH)CH_3$, $CH_2COOR^8$, or $CH_2CH_2COOR^8$, wherein $R^8$ has the same meanings as $R^1$ independently of $R^1$.

3. The process of claim 2 wherein the bleach stabilizer is an unsubstituted iminodisuccinic acid or a salt of an unsubstituted iminodisuccinic acid.

4. The process of claim 1 wherein the surfactant (b) is selected from the group consisting of nonionic surfactants and amphoteric surfactants.

5. The process of claim 4 wherein the amphoteric surfactant is a betaine of the following formula (II)

$$(C_{10}\text{–}C_{22}\text{-alk(en)yl)—X—N(R}^1,R^2)\text{—(C}_1\text{–C}_4\text{-(hydroxy)alkylene)—COO}^{\ominus} \quad \text{(II)}$$

wherein

X is a single bond or the group —CO—NH—($C_2$–$C_3$-alkyl)—, and $R^1$ and $R^2$ are independently hydrogen, methyl, or hydroxyethyl.

6. The process of claim 4 wherein the amphoteric surfactant is an amine oxide of the following formula (IV)

$$(C_{10}\text{–}C_{22}\text{-alk(en)yl)—X—N(R}^1,R^2)\rightarrow O \quad \text{(IV)}$$

wherein

X is a single bond or the group —CO—NH-($C_2$–$C_3$-alkyl)-, and $R^1$ and $R^2$ are independently hydrogen, methyl, or hydroxyethyl.

7. The process of claim 5 wherein the dispersant is a polyaspartic acid containing essentially repeating units of the following structure (i) 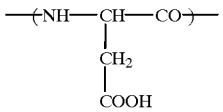 (α-form)

and (ii) 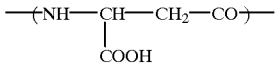 (β-form).

8. The process of claim 7 wherein the dispersant comprises more than 50% polyaspartic acid having the β-form.

9. The process of claim 7 wherein the dispersant comprises more than 70% polyaspartic acid having the β-form.

10. The process of claim 1 wherein the liquor is rendered alkaline using a component selected from the group consisting of NaOH and $Na_2CO_3$.

11. The process of claim 10 wherein the pH ranges from about 10to 14.

12. The process of claim 10 wherein the pH ranges from about 11 to 13.

13. A combination product used for the process of claim 1 comprising (a) 15–65% by weight of one or more bleach stabilizers comprising an iminopolycarboxylic acid or salt thereof of the formula (I) or mixtures thereof, (I)

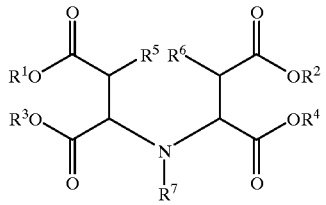

wherein $R^1$, $R^2$, $R^3$ and $R^4$ are independently H, Li, Na, K, $NH_4$, $H_3N(CH_2CH_2OH)$, $H_2N(CH_2CH_2OH)_2$, or $HN(CH_2CH_2OH)_3$, $R^5$ and $R^6$ are independently H or OH, and $R^7$ is H, $CH_2CH_2OH$, $CH_2CH_2CH_2OH$, $CH_2CH(OH)CH_3$, $CH_2COOR^8$, or $CH_2CH_2COOR^8$, wherein $R^8$ has the same meanings as $R^1$ independently of $R^1$, (b) 15–65% by weight of a combination of a nonionic surfactant and an amphoteric surfactant, (c) 0–50% by weight of one or more dispersants, and (d) 0–20% by weight of further components, wherein the percentages are based on the total amount of the anhydrous components of (a), (b), (c), and (d).

14. A combination product according to claim 13 comprising (a) 15–65% by weight of an iminopolycarboxylic acid of the formula (I)

(I)

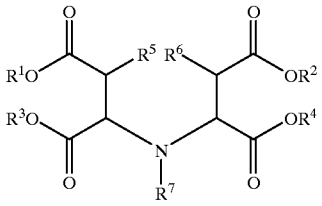

wherein $R^1$, $R^2$, $R^3$ and $R^4$ are independently H, Li, Na, K, $NH_4$, $H_3N(CH_2CH_2OH)$, $H_2N(CH_2CH_2OH)_2$, or $HN(CH_2CH_2OH)_3$, $R^5$ and $R^6$ are independently H or OH, and $R^7$ is H, $CH_2CH_2OH$, $CH_2CH_2CH_2OH$, $CH_2CH(OH)CH_3$, $CH_2COOR^8$, or $CH_2CH_2COOR^8$, wherein $R^8$ has the same meanings as $R^1$ independently of $R^1$, (b) 15–65% by weight of a combination of a nonionic surfactant and an amphoteric surfactant, (c) 0–50% by weight of a polyaspartic acid dispersant containing essentially repeating units of the following structure (i) 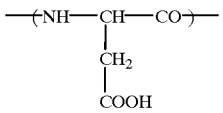 (α-form)

and (ii) 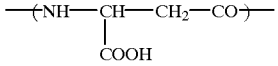 (β-form), and (c) 0–50% by weight of one or more dispersants, and (d) 0–20% by weight of solvents and/or scents, wherein the percentages are based on the total amount of the anhydrous components of (a), (b), (c), and (d).

15. A combination product according to claim 13 wherein bleach stabilizer (a) is unsubstituted iminodisuccinic acid.

16. A composition comprising a 15 to 60% strength by weight aqueous solution of the combination product of claim 13.

* * * * *